United States Patent [19]

Williams

[11] Patent Number: 4,645,886

[45] Date of Patent: Feb. 24, 1987

[54] SWITCH FOR AUTOMATICALLY PROVIDING A SAFETY FUNCTION WHEN ITS CONTACTS ARE FUSED TOGETHER IN THE "ON" POSITION

[75] Inventor: James E. Williams, Stamford, Conn.

[73] Assignee: Cuisinarts, Inc., Greenwich, Conn.

[21] Appl. No.: 718,931

[22] Filed: Apr. 2, 1985

Related U.S. Application Data

[63] Continuation-in-part of Ser. No. 670,554, Nov. 9, 1984, abandoned.

[51] Int. Cl.[4] ..... H01H 9/00

[52] U.S. Cl. ..... 200/1 R; 200/DIG. 42; 307/326; 340/644

[58] Field of Search ..... 361/189; 307/116, 117, 307/326; 200/146, 153 T, 1 V, 1 R, DIG. 42; 340/644

[56] References Cited

U.S. PATENT DOCUMENTS 4,105,882 8/1978 Ulbing et al. ..... 200/DIG. 42

*Primary Examiner*—A. D. Pellinen
*Assistant Examiner*—Morris Ginsburg
*Attorney, Agent, or Firm*—Parmelee, Bollinger & Bramblett

[57] ABSTRACT

A switch for providing a safety function when its main contacts are fused or stuck together in the "ON" position, comprising a housing containing a pair of main contacts, one being designated an ON contact, and the other main contact being carried by a movable switch arm in the housing. This switch arm has a first end which carries the movable main contact and a second end, and spring means mechanically coupled to the movable switch arm normally bias the movable main contact toward open position away from engagement with the ON contact. Switch operating means including movable actuator means overcome the biasing force of the spring means for moving the movable main contact to closed position into engagement with the ON main contact. There are auxiliary safety contact means positioned proximate to the second end of the movable switch arm for completing a safety circuit and for deenergizing a main circuit in response to abnormal movement of the second end of the movable switch arm under influence of the biasing force of the spring means when the actuator means is moved to OFF position, but the movable main contact remains fused or stuck to the ON main contact. In a further embodiment, safety contact means become triggered and moved from a first to a second position for providing a safety function when the actuator means are moved to OFF position but the main contacts remain fused or stuck together in their ON relationship.

35 Claims, 11 Drawing Figures

FIG. 1
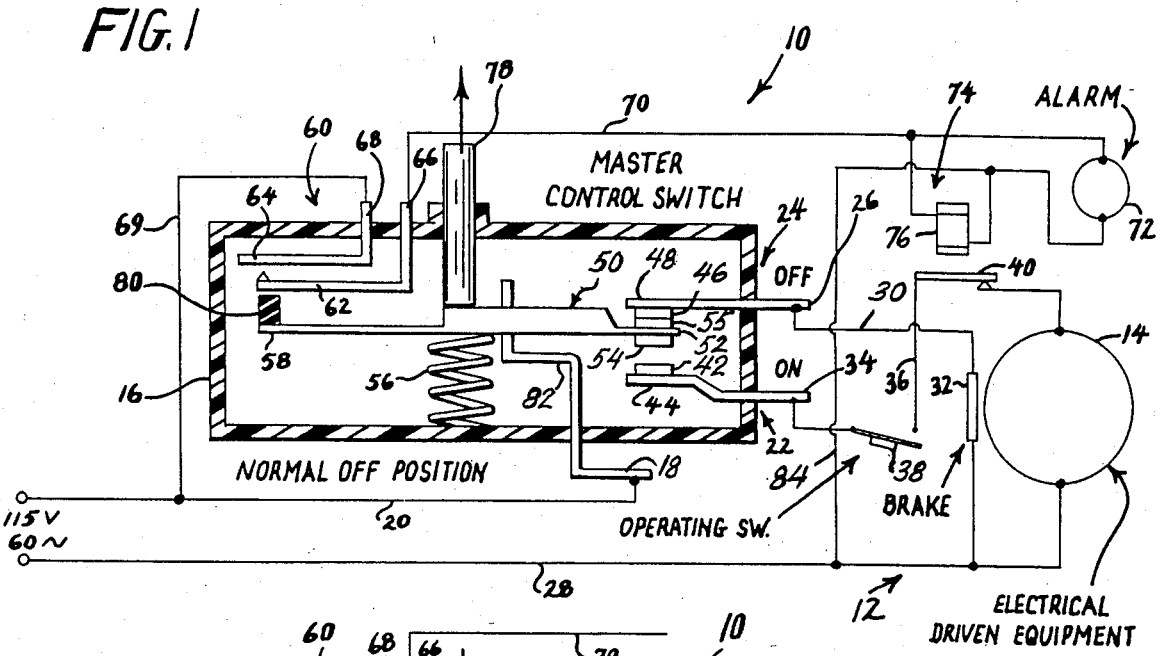
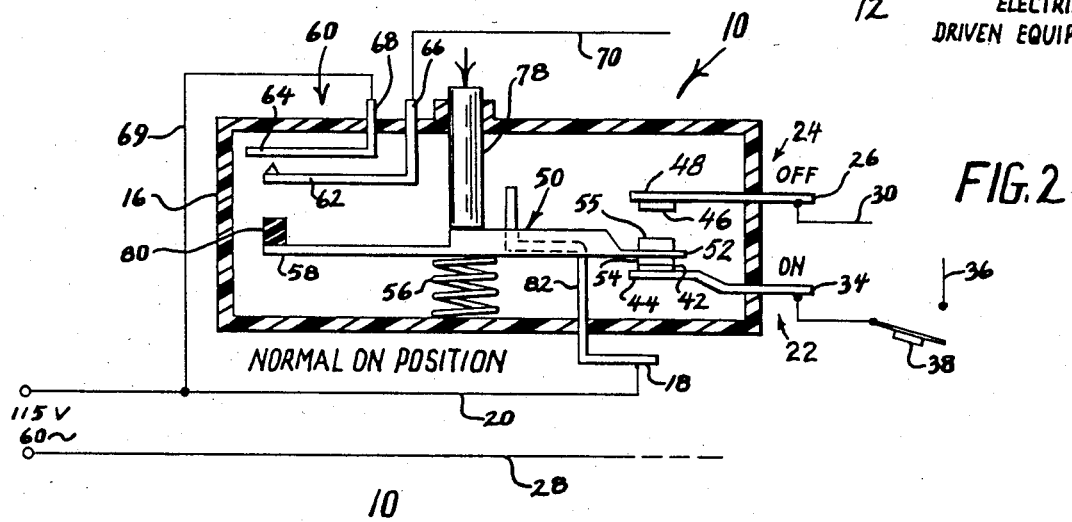
FIG. 2
FIG. 3
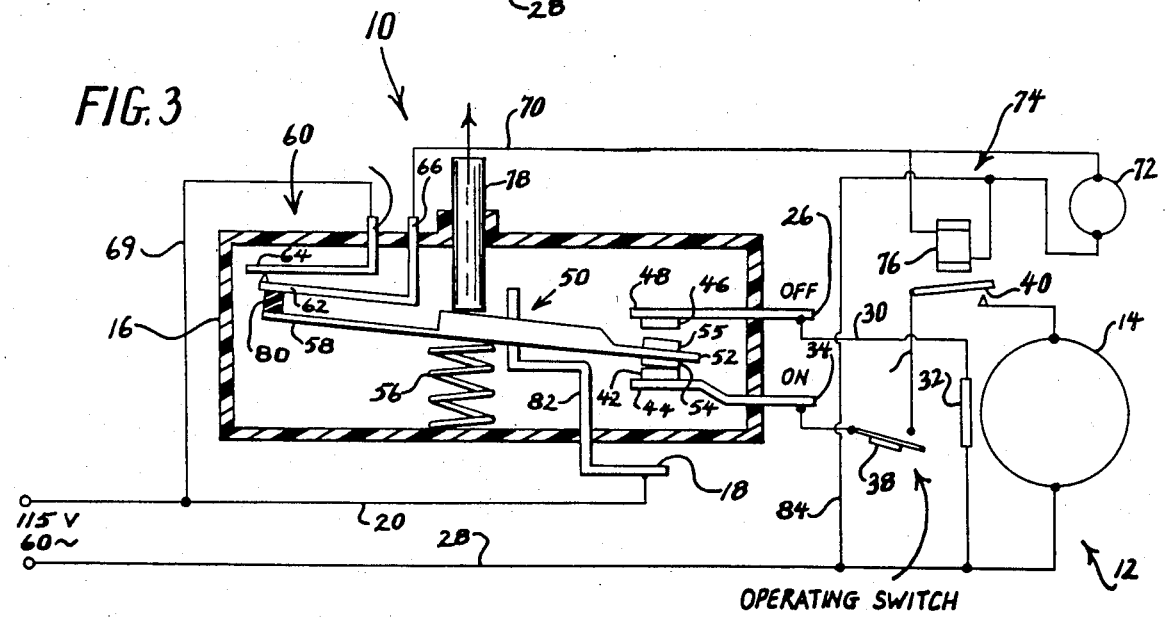

SWITCH FOR AUTOMATICALLY PROVIDING A SAFETY FUNCTION WHEN ITS CONTACTS ARE FUSED TOGETHER IN THE "ON" POSITION

RELATED APPLICATION

This is a continuation-in-part of application Ser. No. 670,554 filed Nov. 9, 1984, now abandoned.

BACKGROUND OF THE INVENTION

The present invention relates to control switches, and more particularly to a control switch for automatically providing a safety function when the main contacts remain fused or stuck together in the "ON" position after the switch actuator has been moved to the "OFF" position.

During the operation of electrical equipment, occasions can arise in which the contacts of a control switch, e.g., a microswitch, become fused, welded or stuck together in their ON position. This fused condition can occur under heavy load when increased current is being drawn at the instant when the switch is turned OFF, with the result that there is arcing across the ON contacts occurs, and therefore fusing or welding of the contacts causing them to remain in their closed position, even though the switch operating means has been moved to OFF position.

For example, a control switch may be used to operate alternating current electrical equipment including a motor. If the switch actuator happens to be moved to the OFF position at an instant during a cycle of the alternating current when peak current is flowing in a heavily loaded motor, severe arcing with consequent welding can occur as the contacts start to part, due to the energy stored in the magnetic field of the motor which momentarily tends to maintain a large current flow through the contacts as they start to separate. Therefore, the contacts remain fused together in their ON condition, after the switch operating means has been turned OFF.

With a switch in this fused or "welded" condition, the circuit to the electrical equipment is still capable of energizing the equipment. Further, a switch in this welded condition is quite dangerous to the operator of the equipment, since the operator knows that steps have previously been taken to turn OFF the control switch, which normally opens (deactivates) the electrical circuit. Moreover, if the operator visually checks the switch actuating the mechanism, it is seen to be in its open circuit position. If the switch housing is visible and the operator visually checks, viewed from the exterior of the switch housing, the switch appears to be deactivated or turned OFF, because the visible switch actuating mechanism, e.g., an actuator or manually movable handle, is in its OFF position, However, the internal contacts, which are welded or stuck together, remain in their ON position.

The operator of the electrical equipment is lulled into a false sense of security when he/she looks at an operating control or at the switch and sees that the switch actuating mechanism is in its OFF position. Consequently, the operator incorrectly concludes that the circuit to the electrical equipment has been safely de-energized. The operator may then proceed to perform maintenance or cleaning of the equipment, assuming that the equipment cannot be activated. In the course of such service, the operator may accidentally engage a nearby operating switch. The circuit to the equipment is then completed and the equipment then proceeds to operate, with possible consequential damage to the equipment or injury to the operator. Moreover, if the equipment has been partially disassembled for maintenance, and then is activated, considerable damage may occur.

The terms "fused", "welded" or "stuck" are used herein interchangeably in a generic sense to mean that the main contacts of a switch are remaining together touching or joining each other in a current-conducting relationship, when these main contacts are intended to be separated from each other in a non-conducting relationship by moving the switch operating means to the OFF position.

SUMMARY OF THE INVENTION

It is an object of the present invention to provide a switch which provides a safety function when its main contacts inadvertently remain fused, welded or stuck together, after the switch actuator has been moved to OFF position.

It is an object of the present invention to provide a switch which automatically provides a safety function if its contacts have been fused, welded or stuck together in their ON position, when the switch actuator is moved to the OFF position.

It is an object of the present invention to provide auxiliary contact means which become moved if the switch is turned OFF but its main contacts remain in their ON position.

An object of this invention is to provide a safety switch having spring-biased auxiliary safety contact means which become triggered and released from a first position to a second position for producing a safety function, when the switch operating means are moved to OFF position but the main contacts of the switch remain together in their ON position.

Among the advantages of the present invention are those resulting from safety apparatus to be incorporated in a switch. This safety apparatus includes auxiliary contacts which are moved from a first relationship to a second relationship for producing a safety function in the event the main switch contacts remain together in their closed or ON position after the switch operating means have been moved to the OFF position.

It is a further object of the present invention to provide a switch having auxiliary safety contacts for automatically deactivating a circuit controlled by the switch to prevent energization of equipment in the circuit when the main switch contacts remain together in their ON condition, after the switch has been turned OFF.

It is a further object of the present invention to provide a switch having auxiliary safety contacts for producing an audible and/or visible alarm signal when its main contacts remain together,after the switch operating means are turned OFF.

It is a still further object of the present invention to provide a switch having auxiliary safety contacts for automatically energizing a circuit to transmit a signal to a remote location for alerting personnel that the control switch has malfunctioned by its main contacts remaining in their ON position, after the switch actuator has been moved to OFF position.

The present invention provides a switch which advantageously protects the operator of driven electrical equipment from accidental injury when the contacts of the switch remain together in their ON position, after the switch actuator has been moved to its OFF position.

Briefly, in accordance with the present invention, a switch is provided including a housing having a common terminal and an ON terminal each extending to the exterior of the housing, the ON terminal having an ON contact thereon located within the housing, a movable switch arm in the housing having first and second ends with movable contact means carried by the first end of the movable switch arm, the movable switch arm being movable between open and closed positions, spring means in the housing for urging the movable switch arm to its open position, a movable actuator accessible from the exterior of the housing and operatively associated with the movable switch arm for moving the movable switch arm from its open to its closed position for causing the movable contact carried by the first end of the movable switch arm to touch the ON contact when the movable switch arm is in its closed position, the actuator when released allowing the spring means to return the movable switch arm from its closed to its open position, and electrically conductive means in the housing for completing a conductive path between the common terminal and the movable contact means for completing an electrically conductive path between the common terminal and the ON terminal when the movable contact touches the ON contact, with apparatus capable of automatically actuating a safety circuit in the event the movable contact becomes welded to the ON contact, comprising safety switch means located within the housing and positioned proximate to the second end of the movable switch arm, the safety switch means including at least one terminal extending to the exterior of the housing for connection to a safety circuit, and the safety switch means becoming activated when the movable actuator has been released and the spring means attempts to return the movable switch arm to its open position, while the movable contact is welded to the ON contact.

In accordance with the present invention in certain of its aspects safety apparatus is provided in a switch having first and second main contacts, switch operating means movable in a first direction for causing said main contacts to touch each other for turning the switch ON, said switch operating means being movable in a second direction for causing said main contacts to separate for turning the switch OFF, such safety apparatus in the switch comprises: first and second auxiliary contact means, a movable member operatively associated with said first and second auxiliary contact means and with said switch operating means, said first auxiliary contact means normally being held by said movable member in a first relationship with respect to said second auxiliary contact means, spring bias for urging said movable member to move said first auxiliary contact means into a second relationship with respect to said second auxiliary contact means for producing a safety function, said movable member normally being restrained against said spring bias by said switch operating means, and said movable member being released to respond to said spring bias in the event that said switch operating means is moved in said second direction but said main contacts do not become separated and thus the switch is actually not OFF for releasing said movable member to be moved by said spring bias for moving said first auxiliary contact means into said second relationship with respect to said second auxiliary contact means for producing said safety function.

In accordance with the present invention in certain aspects, the safety apparatus provided in such a switch comprises: first and second auxiliary contact means, the first auxiliary contact means normally being in a first relationship with respect to the second auxiliary contact means, the first auxiliary contact means being movable into a second relationship with respect to the second auxiliary contact means for producing a safety function, and a movable member operatively associated with said switch operating means for moving said first auxiliary contact means into said second relationship with respect to said second auxiliary contact means for producing said safety function in the event that the switch operating means is moved into position for separating the main contacts of the switch, i.e., for turning the switch OFF, but the main contacts do not become separated and thus the main contacts of the switch are actually not in OFF condition.

Other objects, aspects and advantages of the present invention will be understood from the detailed description considered in conjunction with the drawings, which are presented herein and should be construed in an illustrative but not in a limiting sense, as follows:

BRIEF DESCRIPTION OF THE DRAWINGS

FIG. 1 is an enlarged side elevation view of the components of a switch embodying the present invention showing the switch electrically coupled to driven electrical equipment and deactivating/warning safety circuitry, with the housing of the switch being cut away in section and the switch shown in its normal OFF position;

FIG. 2 is an enlarged side elevation view of the switch of FIG. 1, with the switch in its normanl ON position;

FIG. 3 is an enlarged side elevational view of the switch of FIG. 1, the main switch contacts "welded" together in their ON position, when externally the switch operating means give the appearance that the switch is in its OFF position. Consequently, auxiliary safety contact means in the switch have functioned to give a warning and to deenergize the electrical driven equipment which is normally controlled by the main contact of the switch;

DETAILED DESCRIPTION

Figure 4:
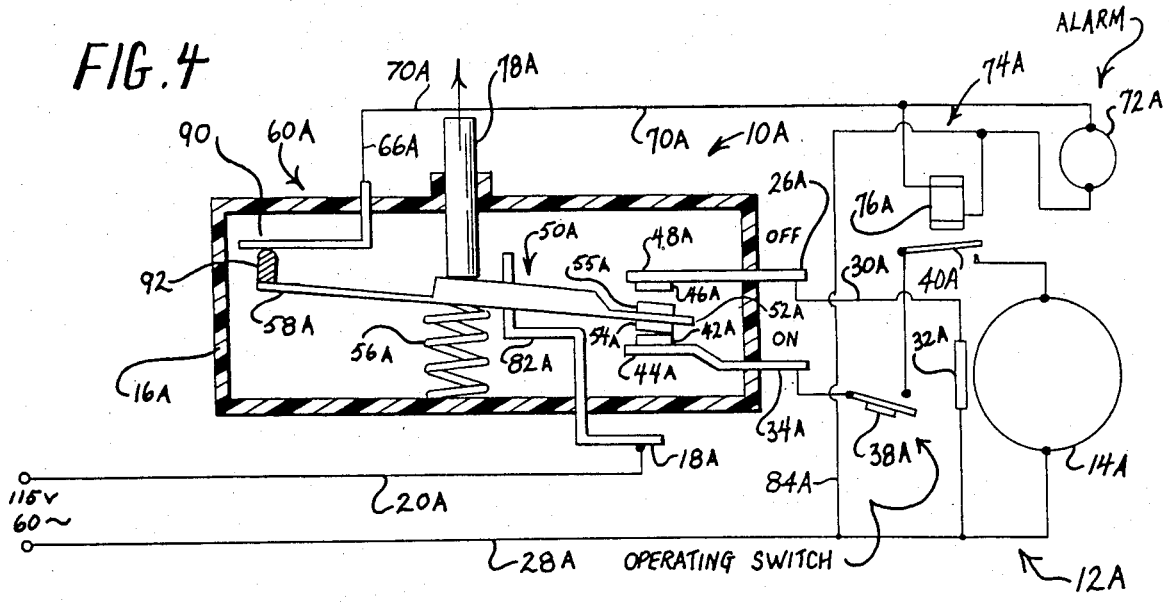
FIG. 4 is an enlarged side elevational view of a switch embodying the present invention in which there is only one auxiliary safety contact with one external terminal.

It has been a long standing problem that switch contacts can occasionally unexpectedly become welded or fused or stuck together in their ON or closed circuit condition, when appropriate steps have been taken by an operator or by control mechanism which are intended to turn OFF, i.e., to open a circuit, with consequent possible damage to electrical equipment controlled by the switch or possible injury to the operator or both. The present invention has solved this problem in a practical, compact and feasible manner, and this invention readily lends itself to be incorporated in various advantageous embodiments in various switches.

Referring to FIG. 1, a switch embodying the present invention is illustrated generally at 10. The switch 10 is shown as a master control switch for opening and closing a control circuit 12 which energizes driven electrical equipment 14, for example, such as an electric motor drive. The switch 10 includes an insulating housing 16 having a common terminal 18 affixed to the housing 16 and extending externally therefrom. One line 20 from a power source (not shown), e.g., a 115 V, 60 Hz A.C. voltage source, is electrically coupled to the common terminal 18.

A pair of spaced ON and OFF terminals 22 and 24 are also affixed to the housing 16 and extend externally therefrom. The external end 26 of the OFF terminal 24 is electrically connected to the other line 28 from the power source, e.g. through a lead 30 and brake 32. The external end 34 of the ON terminal 22 is electrically connected to the driven electrical equipment 14 and the line 28, e.g. through a lead 36, an operating switch 38 and relay contacts 40.

The ON terminal 22 has an ON contact 42 affixed to its internal end 44 located within the housing 16. Similarly, the OFF terminal 24 has an OFF contact 46 affixed to its internal end 48 located within the housing 16. The ON contact 42 and OFF contact 46 are positioned relative to one another to receive a movable switch arm 50 therebetween. Specifically, the first end 52 of the movable switch arm 50 is interposed between the ON contact 42 and the OFF contact 46.

Affixed to the first end 52 of the movable switch arm 50 is contact 54 which moves with the movable switch arm 50 from a first ("ON") position of engagement with, i.e., touching, the ON contact 42 (FIG. 2) to a second ("OFF") position of separation from this ON contact 42 (FIG. 1). Also shown affixed to this first end 52 of the movable switch arm 50 is another contact 55 which moves with the switch arm. When the switch arm is in its second (OFF) position as shown in FIG. 1, the movable contact 55 is in engagement with (touches) the OFF contact 46. The movable switch arm 50 is normally biased upwardly by a spring 56, so that the movable contact 55 engages the OFF contact 46. Advantageously, the spring 56 is mechanically coupled to the movable switch arm 50 and, e.g., affixed to the housing 16, or other stationary component of the switch 10, to provide a bias force for urging the switch arm 50 toward the OFF position.

The ON contact 42 and the movable contact 54 are the "main" contacts of the switch 10. When these main contacts 42 and 54, touch each other, they enable the electrical circuit 12 which is controlled by the switch 10 and which contains the equipment 14 to be energized.

There is a member 58 forming an extension at the second end of the movable switch arm, and this member 58 is positioned proximate to but normally spaced from auxiliary safety contact means generally indicated at 60. As shown in FIG. 1, the auxiliary safety contact means 60 include a pair of spaced safety contacts 62 and 64. Contact 62 has a terminal portion 66 extending externally of the housing 16 and contact 64 also has a terminal portion 68 extending externally of the housing 16. The terminal portions 66 and 68 of these auxiliary contacts 62 and 64 are advantageously affixed to the housing 16, and these auxiliary contacts are normally separated from each other, as seen in FIGS. 1 and 2.

A lead 69 electrically connects the line 20 to the terminal portion 68. Lead 70 connects the terminal portion 66 to the line 28 through an audio or visual alarm 72 and/or electrical equipment deactivating means 74, illustrated as a relay 76, which opens relay contacts 40 for deactivating the electrical equipment 14, and through lead 84. Advantageously, the electrical equipment deactivating means 74 may also provide for permanent deactivation by using a quick-acting heating element at the location of the relay winding 76 for heating a nearby fuse incorporated in the control circuit 12 in place of the relay contact 40. This burnt fuse is replaced when the malfunctioned switch 10 is replaced.

This switch 10 includes operating means for moving its main contacts 42 and 54 into closed ("ON") position and into open ("OFF") position. These switch operating means include a movable actuator shown in the form of a manually or mechanically actuatable plunger 78 which is accessible from the exterior of the housing 16, and is mechanically coupled to the movable switch arm 50. However, it is to be understood that the actuator may also be automatically actuated. The movable switch arm 50 is included in the switch operating means, and the actuator 78 is capable of moving this switch arm 50 from its open to its closed position, when the actuator 78 is moved by external means to cause the main contact 54 affixed to the first end 52 of the movable switch arm 50 to engage the ON main contact 42. Upon release of the actuator 78, the spring force of the spring 56 returns the movable switch arm 50 to its open position, as shown in FIG. 1, with contact 55 engaging contact 46.

It is to be understood that conductive means are included in the switch housing 16 for providing an electrically conductive path continuously existing between the common terminal 18 and the movable switch arm 50, for example, this terminal 18 is mechanically and electrically connected to a conductive element 82 which, in turn, is mechanically and electrically coupled as desired to the switch arm 50, for example, by abutting against the arm for maintaining sliding contact therewith or through a hinged linkage (for example, such as shown at 104 in FIG. 5) or through the spring 56. Thus, the common terminal 18 is continuously electrically connected to the movable arm 50 during its movement and when the contact 54 or 55 carried by this arm is respectively engaging the ON contact 42 or the OFF contact 46.

Referring to FIG. 2, when the actuator 78 is depressed, the main contact 54 is moved into engagement with the ON main contact 42, with movable switch arm 50 now moved to its closed position. Thus, the normal sequence of operation for a correctly functioning switch 10 is illustrated in FIGS. 1 and 2 with the movable switch arm 50, spring 56 and actuator 78 moving the main contact 54 into engagement with the ON main contact 42 to place the switch 10 in the ON position as shown in FIG. 2, when the actuator 78 is depressed; and moving the contact 55 into engagement with the OFF contact 46, as shown in FIG. 1, when the actuator 78 is released. The member 58 of the movable switch arm 50 advantageously includes an insulating element 80 which moves with the movable switch arm 50, but is dimensioned so that it does not normally affect the auxiliary safety contact means 60, the latter remaining open so that the circuit to the alarm 72 and deactivating means 74 remain inoperative.

However, should sufficient current be flowing through the lines 20 and 28,so that arcing occurs between the main contact 54 and ON main contact 42, as they are being separated, the contacts 54 and 42 may become fused or welded together. If fusing occurs, the contact 54 will remain electrically connected to the ON contact 42, when the actuator 78 is in its released or open position as shown in FIG. 3. That is, with the main contact 54 and ON main contact 42 fused together as shown in FIG. 3, upon release of the actuator 78, it will move upward under the force of the spring 56 to the same position as shown in FIG. 1. Thus, viewed from the exterior of the housing 16, it appears that the movable switch arm 50 and contact 54 are in the OFF position as shown in FIG. 1 with the master control switch 10 open, so that the electrical equipment 14 cannot be energized even upon intentional or accidental closure of the operating switch 38. However, in actuality, as seen from the interior of the housing in FIG. 3, the contact 54 remains fused to the ON contact 42, and the master control switch 10 remains ON in its closed condition.

Advantageously, if the contact 54 remains fused to the ON contact 42 when the actuator 78 is released, the movable switch arm 50 is dimensioned so that the spring 56 will force the movable switch arm 50 upward causing it to effectively pivot about the weld or fusion between the contact 54 and the ON contact 42, with the result that the insulating element 80 on the member 58 forming an extension at the second end of the movable switch arm 50 pushes safety contact 62 deflecting its terminal portion and thus forcing it into engagement with safety contact 64.

In summary, the member 58 is operatively associated with the switch operating means 78, 50 and 56. When these switch operating means are moved to OFF position, but the main contacts 54, 42 remain together in their ON position, then the auxiliary safety contact means 60 are moved by the member 58 into a second relationship, as shown in FIG. 3 for producing a safety function. Thus, a circuit is completed through the safety contacts 62 and 64 to the alarm 72 and relay 76 to provide a visual or audible warning of this switch malfunction and/or to deactivate the electrical equipment control circuit 12 by opening the relay contacts 40, see FIG. 3. Further, it is to be understood that closure of safety contacts 62 and 64 may also be utilized to provide a signal to a remote location for indicating this switch malfunction.

Referring to FIG. 4, an alternative embodiment of the present invention is illustrated as switch 10A, with components of this switch 10A which are similar to corresponding components of the switch 10 being given similar reference numerals. However, with this embodiment of the present invention, the auxiliary safety contact means 60A include only a single external terminal 66A with a contact 90 which is closed by engagement with a conductive contact portion 92 affixed to the member 58A forming an extension at the second end of the movable switch arm 50A and thus being operatively associated with the switch operating means 78A, 50A and 56A. When the switch operating means 78A, 50A and 56A are moved to their OFF position, but the main contacts 54A and 52A remain together in their ON position, then the member 58A causes the auxiliary safety contact means 60A to move into a second relationship as shown in FIG. 4 for producing a safety function. The auxiliary contacts 92 and 90 are moved together for completion of the circuit including the lead 70A to the alarm 72A and deactivating relay 76A to provide an audible or visual alarm of the welded condition of the contacts 54A and 42A and/or for deactivation of the electrical circuit 12A including equipment 14A.

The circuit including the lead 70A is completed from the supply line 20A through the common terminal 18A, through the conductive element 82A, through the switch arm 50A and member 58A, through closed contacts 92, 90 and terminal 66A to the lead 70A to the alarm 72A and the deactivating means 74A, 76A for the circuit 12A and through the lead 84A to the other electrical supply line 28A. By virtue of the fact that the circuit 12A has been deactivated by the opening of the relay contacts 40A, the equipment 14A cannot become energized by accidental or intentional closure of the operating switch 38A. It is to be understood that the deactivating means 74A for the circuit 12A may comprise a fuse (not shown) at the location of the relay contacts 40A. Such a fuse is associated with a quick-acting heater (not shown) at the location of the relay winding 76A, with this heater being near the fuse for immediately burning out this fuse when the auxiliary safety contacts 92 and 90 touch each other.

Figure 5:
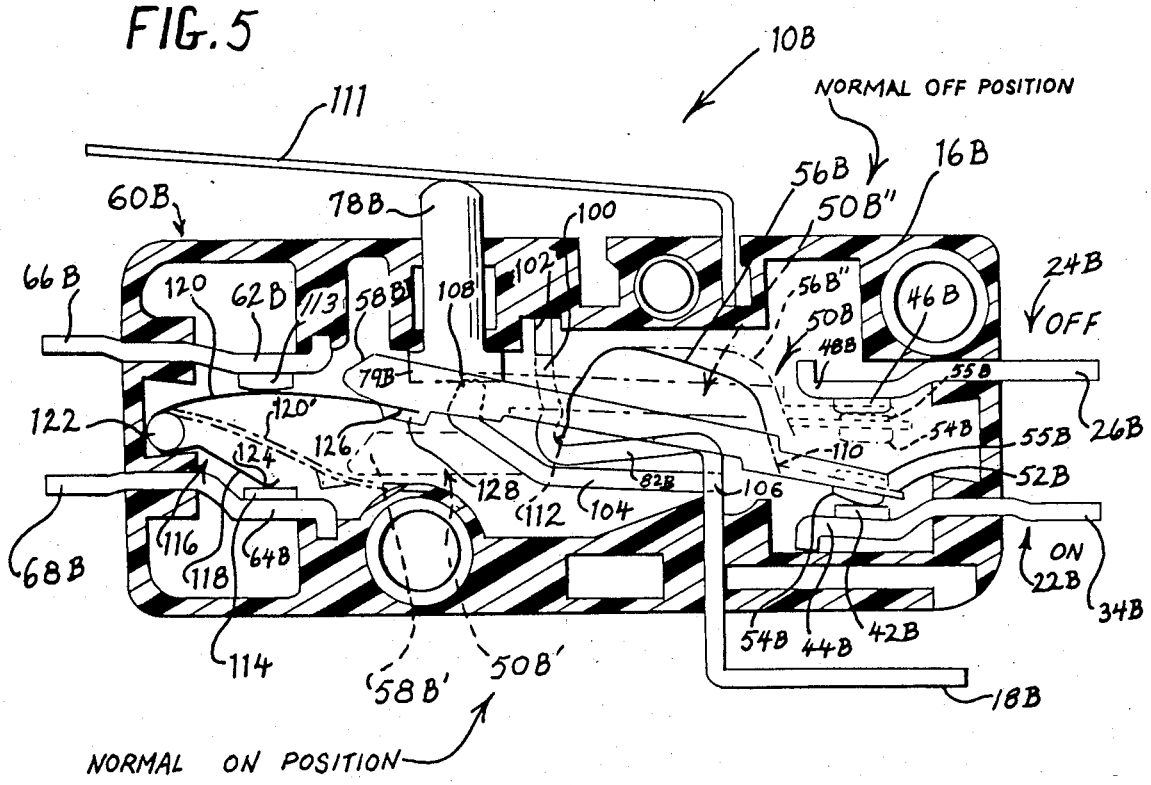
FIG. 5 is an enlarged side elevational view of another switch embodying the present invention in another modification. Three different conditions of this switch are illustrated, including the normal ON position, the normal OFF position, and the abnormal "welded" ON position when the switch is intended to be turned OFF. Consequently, the auxiliary safety contact means have produced a safety function.

Referring to FIG. 5, another embodiment of the present inventon is illustrated as switch 10B, with components of this switch 10B which are similar to corresponding components of the switches 10 and 10A being given similar reference numerals. Common terminal 18B includes an electrically conductive element portion 82B mounted internally of the housing 16B, and its end 100 is secured within the housing by being received within housing slot 102. A second electrically conductive element 104 in the form of a movable hinged linkage is mechanically coupled and hinged at one end to the electrically conductive portion 82B at a slot or socket 106 and at the other end to the movable switch arm 50B at a second slot or socket 108.

A spring means in the form of a bow spring 56B is mechanically coupled at one end to the movable switch arm 50B at a slot or socket 110 and is mechanically coupled at its other end to the electrically conductive portion 82B at a slot or socket 112. The bow spring 56B is under compression, and thus it normally applies an upward component of force to the movable switch arm 50B to bias its contact 55B into engagement with the OFF contact 46B. The OFF or open position of the movable switch arm 50B is shown in dashed outline at 50B'' in FIG. 5.

Depression of the movable actuator 78B, which may advantageously be accomplished through means of manually or automatically depressing a generally L-shaped lever 111 which overlies the movable actuator 78B, causes the electrically conductive linkage 104 and movable switch arm 50B to move downwardly, overcoming the upward bias force of the bow spring 56B to move the movable main contact 54B into engagement with the ON main contact 42B. The normal ON or closed position of the switch arm 50B is shown at dashed outline 50B'.

Upon release of the actuator 78B the movable switch arm 50B normally assumes the open position 50B'' with the movable contact 54B engaging the OFF contact 46B as shown in dashed outline in FIG. 5. However, should fusing or welding of the main contacts 54B and 42B occur, then the movable switch arm 50B will assume the abnormal tilted or canted position shown in solid outline in FIG. 5.

Auxiliary safety contact means 60B are illustrated in FIG. 5 to include two spaced contact elements 62B and 64B and their respective external terminals 66B and 68B. However, it is to be understood that the auxiliary safety contact means 60B may optionally include only one contact element 62B and its external terminal 66B, similar to FIG. 4. In the event there is only the one auxiliary safety contact element 62B with its external terminal 66B, then the associated alarm and/or deactivation circuit is closed by a conductive leaf spring member 116 (FIG. 5) to be described touching a contact 113 of the contact element 62B. The two spaced contact elements 62B and 64B are positioned proximately to leaf spring member 116 associated with the second end 58B of the movable switch arm 50B. Contact elements 62B and 64B include contact portions 113 and 114, respectively. The leaf spring member 116 has a generally U-shaped configuration with a short arm portion 118 and a long arm portion 120, and is positioned with its bight extending around a mounting pin 122 affixed to the housing 16B. The end 124 of the short arm portion 118 is positioned in pressure contact with the contact portion 114 of the contact 64B. The end 126 of the long arm portion 120 is positioned inpressure contact with a notched portion 128 formed near the end 58B of the movable switch arm 50B.

The spring 116 is configured so that upon depression of the actuator 78B by the lever 111 to place the switch 10B in the ON position, the long arm portion 120 of the spring 116 will be deflected downwardly as shown in dashed outline at 120' as the movable switch arm 50B is moved downwardly to the generally horizontal ON position shown in dashed outline 50B' in FIG. 5. The end 124 of the spring 116 will remain in engagement with the contact portion 114 of contact 64B; however, there is no engagement between the deflected spring 120' and the contact portion 113. Thus, the circuit between contacts 62B and 64B and thus between terminals 66B and 68B remains open when the switch 10B is in the ON position.

Upon release of the actuator 78B by the release of the lever 111, the movable switch arm 50B will move upwardly under the biasing force of the bow spring 56B. Normally, when the contacts 54B and 42B are not welded or fused together, upon release of the actuator 78B, the bow spring 56B will move the movable switch arm 50B to the generally horizontal OFF (open) position, as shown in dashed outline at 50B''. The movable contact 54B is now in engagement with the OFF contact 46B, and the spring 116, specifically its long arm portion 120 is positioned slightly below the contact portion 113 in spaced non-contacting relationship. Thus, auxiliary safety contact means 60B remains electrically open, when the switch arm is in its normal OFF (open) position 50B''.

In the event that the contacts 54B and 42B become fused or welded together, when the actuator 78B is released, the bow spring 56B will move the movable switch arm 50B upwardly causing the movable switch arm 50B to effectively pivot about the welded region to assume an abnormal canted or tilted position, as shown in solid outline in FIG. 5. In this canted arm position, the long arm portion 120 of the spring 116 effectively moves upwardly higher than normal, thereby touching the contact portion 113 for completing a circuit between the terminals 66B and 68B.

The long arm spring portion 120 is allowed by canted switch arm 50B to move higher than normal, because the second (left) end 58B of the canted arm 50B is above its normal OFF (open) position 50B''. Also, the long arm spring portion 120 is now allowed to move slightly forward (leftward) in the notched portion 128, since the end 58B of canted switch arm 50B has tilted up slightly above its normal horizontal OFF position, with the result that the point of application of the downward force on the long arm portion 120 is further rearward (rightward) toward the end 126 of the long arm portion 120, thereby allowing the long arm portion 120 to bow upward into engagement with the contact portion 113 to complete a circuit through the auxiliary safety contacts 62B and 64B, and thus through the terminals 66B and 68B. The circuit between the contacts 62B and 64B is now completed through the conductive leaf spring member 116 touching contact portion 113 and 114.

It is to be understood that the switch 10B of FIG. 5 can be connected into any desired electrical control circuit, for example, such as the circuit 12 shown in FIGS. 1 and 3 or, for example, such as the circuit 12A shown in FIG. 4. In other words, the switch 10B can be substituted for the switch 10 in FIGS. 1, 2 and 3, and this switch 10B can be substituted for the switch 10A in FIG. 4.

In operation, referring first to FIGS. 1 through 3, when the actuator 78 is in its released position, as shown in FIG. 1, the spring force from spring 56 biases the movable switch arm 50 upwardly so that the contact 55 normally engages the OFF contact 46. Thus, a circuit is completed from the power source (not shown) through the line 20, the common terminal 18, electrically conductive element 82, movable switch arm 50 and its contact 55, OFF contact 46, OFF terminal 26, lead 30, brake 32, and line 28 to activate the brake 32 and stop the driven electrical equipment 14. Moreover, with the master control switch 10 in the position illustrated in FIG. 1, the electrical equipment 14 cannot be energized even when the operating switch 38 is closed.

However, upon depression of the actuator 78, the upward biasing force of the spring 56 is overcome, and the movable switch arm 50 is moved downwardly under the influence of the force of the actuator 78, so that the contact 54 engages the ON contact 42, as seen in FIG. 2. The circuit to the brake 32 is now open, and the circuit to the electrical equipment 14 is placed in a ready state by completion of a circuit to one side of the operating switch 38 through line 20, common terminal 18, electrically conductive element 82, movable switch arm 50, ON contact 42, and ON terminal 34. The other side of the operating switch 38 is electrically coupled to the power source through the line 28, the electrical equipment 14, and the relay contacts 40. Thus, upon closure of the operating switch 38 by the operator the electrical equipment 14 is energized to run.

In the event that the main contact 54 and the ON main contact 42 remain fused or welded together, when the actuator 78 is released, the brake 32 is not energized and the electrical equipment 14 remains in the dangerous condition of being capable of being energized upon intentional or accidental closure of the operating switch 38. Further, the brake 32 is not being energized to stop any coasting of the electrical equipment 14. However, advantageously, the auxiliary safety contact means 60 are closed by the movable member 58 on the movable switch arm 50 in its abnormal position for causing the circuit to the alarm 72 and relay 76 to be completed from the power source through line 20, lead 68, safety contacts 64 and 62, and lead 70 through alarm 72 and relay 76 and lead 84 to line 28. Thus, an audible or visual alarm is provided, and the electrical equipment 14 is deactivated by opening relay contacts 40, or a fuse as described earlier. Therefore, even in the presence of intentional or accidental closure of the operating switch 38, the electrical equipment 14 remains deactivated. Further, a safety indication 72 is provided to the operator that the brake 32 has not been energized to stop the electrical equipment 14 if it is coasting after the switch operating means has been moved to OFF position.

The operation of the auxiliary safety contact means 60A in FIG. 4 is similar to that showh in FIGS. 1–3, with the exception that the contact 90 is closed through engagement with an electrically conductive contact 92 by the movable member 58A on the movable switch arm 50A. A circuit is completed from the power source through line 20A, common terminal 18A, electrically conductive element 82A, movable switch arm 50A, safety contact 92, safety contact 90, lead 70A, through alarm 72A, relay 74A and lead 84A to line 28A back to the power source.

The operation of the auxiliary safety contact means 60B in FIG. 5 to close a circuit to the power source is similar to that shown in FIGS. 1 to 3. However, in the embodiment of FIG. 5, the abnormal upward canting movement of the movable switch arm 50B allows the long arm portion 120 of the spring member 116 to come into engagement with the contact portion 113 of the contact terminal 62B for completing a circuit between the contact portions 114 and 113 and thus completing a circuit between the terminals 66B and 68B, when the contacts 54B and 42B are fused or welded together and the actuator 78B is released.

A modified embodiment similar to FIG. 5 may be employed which includes only a single contact member 62B, and external terminal 66B, and the second contact 64B and terminal 68B as shown in FIG. 5 would be eliminated. With such a modified embodiment, the external electrical connections would be similar to those in FIG. 4. The end 124 of the short arm portion 118 of the spring 116 would rest against an insulating portion of the housing 16B. Completion of the electrical circuit to the various safety devices would occur when the long arm portion 120 engages the contact portion 113 of the contact 62B, with the circuit through the master control switch 10B being completed through the terminal 66B, contact portion 113, spring member 116, movable switch arm 58B, electrically conductive elements 104 and 82B, and terminal 18B.

The various switch embodiments of the present invention are described as including an OFF contact 46, 46A or 46B and an OFF external terminal 26, 26A or 26B. It is to be understood that the intended meaning of "OFF contact" is to be broadly construed to include either a conductive or a non-conductive element against which a portion of the first end 52, 52A or 52B of the switch arm 50, 50A or 50B comes to rest when the switch arm is in its normal OFF (open) position. For example, the OFF contact 46, 46A or 46B can be omitted entirely to be replaced by a non-conductive abutment or fixed post serving merely as a mechanical stop in the housing 16, 16A or 16B, and then the external OFF terminal 26, 48 or 26A, 48A or 26B, 48B is also omitted. In other words, the described embodiments of the present invention solve the problem of main switch contacts 42, 54 or 42A, 54A or 42B, 54B becoming fused, welded or struck together in their ON position, regardless of whether the OFF contact is conductive or non-conductive or omitted or non-existent or is present but not utilized in any external circuit. It is to be understood that the OFF contact (or button element) 55 or 55A or 55B carried by the first end 52, 52A or 52B of the switch arm 50 or 50A or 50B serves as a mechanical stop which abuts against an opposed element, such as a contact or stop 46, 46A or 46B, when the switch arm is moved to its normal OFF position, for limiting and defining the amount of upward travel of this first end of the switch arm when it is moved to its open (OFF) position as pushed upwardly by the spring means 56, 56A or 56B. The shoulders 79B on the actuator 78B normally serve as stop means for limiting the upward travel of the second end of the switch arm. In the switches 10 and 10A, the upward travel of the second end of the switch arm 50 or 50A is limited by the length of the spring 56 or 56A. If desired, shoulders similar to those at 79B in FIG. 5 can be provided on the actuator 78 or 78A.

Referring to FIGS. 6 through 10, a further embodiment of the present invention is illustrated as switch 10C, with components of this switch 10C which are similar to corresponding components of the switch 10 or 10A or 10B being given similar reference numerals. The right half of this switch 10C is very similar to the right half of the switch 10B, except that the contact element 46C merely serves as a mechanical stop and does not perform any electrical function. This stop contact 46C is mounted upon a support 48C which is anchored in the wall of the housing 16C. The housing 16C is molded of durable rigid insulating plastic material in two mating parts. After the switch components have been assembled in the interior of the housing, its two mating parts are secured together by fastening means, for example, rivets or screws or bolts and nuts, which are inserted through appropriate mounting holes, for example, at 94 and 96. It is to be understood that the other switch housings 16, 16A and 16B can similarly be assembled from two mating parts.

The left half of this switch 10C is different from the left half of the switch 10B, as will now be explained. There is a control leg 130 extending diagonally from the left (second) end of the movable switch arm 50C. The foot end 129 of this diagonal control leg 130 is received loosely in a recess 132 at the lower left corner of the housing 16C. The purpose of this diagonal control leg 130 is to stabilize, define and mechanically control the desired movement of the switch arm 50C for making its motion behave in a predetermined manner as will now be explained.

Figure 6:
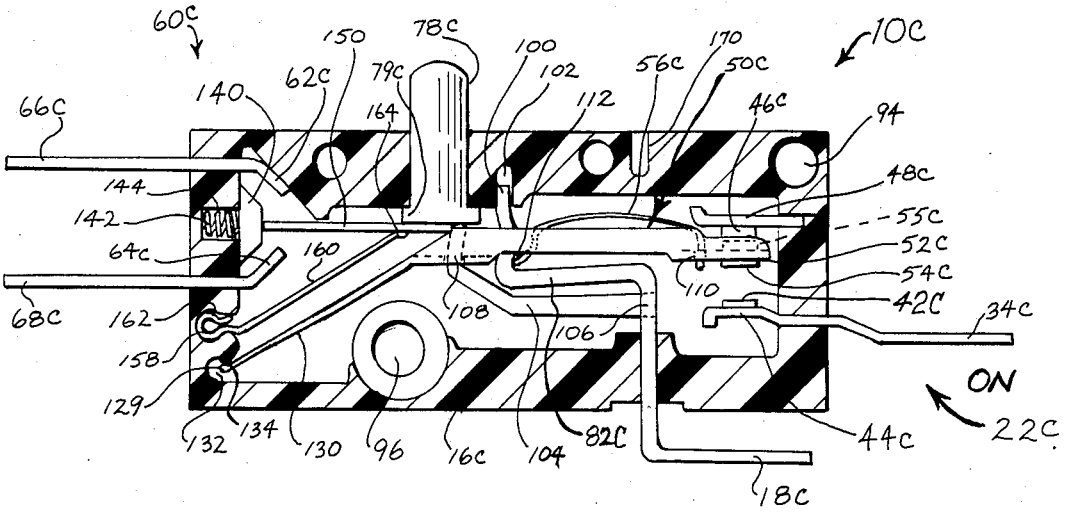
FIG. 6 is an enlarged side elevational view of a switch comprising another embodiment of the invention, with the housing of the switch being shown cut away in section and the switch shown in its OFF position.

In FIG. 6, the switch arm 50C is shown in its normal open (OFF) position with its main contact 54C separated from the ON main contact 42C. The foot end 129 of the control leg is abutting at 134 against the top of the recess 132, while the button element 55C abuts against the stop 46C. In other words, the bow spring 56C is exerting an upward component of force, and the upward travel of the switch arm 50C is stopped at 134 and at 46C. Also, the shoulders 79C serve as stops for limiting upward travel of the actuator 78C and of the switch arm.

Figure 7:
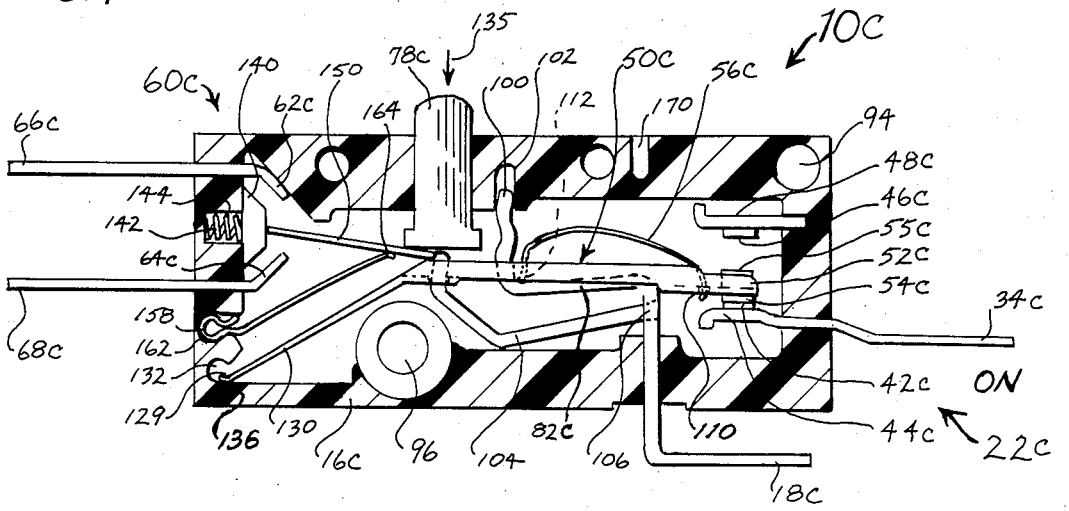
FIG. 7 is an enlarged side elevation view of the switch of FIG. 6, showing its ON position.

In FIG. 7, the switch arm 50C is shown in its normal closed (ON) position with the main contacts 54C and 42C firmly touching each other. As the actuator 78C is moved downwardly (arrow 135) in going from its initial outer position shown in FIG. 6 to its fully depressed position shown in FIG. 7, the foot end 129 initially moves down in its recess 132 until it touches the lower side of this recess at 136 as shown in FIG. 7. This mechanical abutting at 136 arrests the downward movement of the control leg 130 and thereby positively causes the right (first) end 52C of the switch arm 50C to swing down firmly for bringing the main contacts 54C and 42C together in firm contact as shown in FIG. 7.

Summarizing, during the downward motion 135 of the actuator 78C, the foot end 129 moves down until it abuts against the housing wall at 136. Thereafter, this foot end 129 acts like a fulcrum pivot, forming a pivot point at 136 for positively causing the first end 52C of the switch arm 50C to swing down firmly into the closed position, as shown in FIG. 7. The bow spring 56C plus the hinged link 104 produce a quick-acting toggle-like action. Consequently, after the fulcrum pivot has been established at 136 and after the first end 52C of the switch arm has begun to swing down and while the hinged link 104 is swinging down about its fixed pivot point at 106, the bow spring moves past its toggle position, and then the first end 52C of the switch arm swings down quickly with a snap-like action into its fully closed position, as shown in FIG. 7. The spring 56C continues to exert an upward component of force, but the main contacts are held firmly closed by the depressed 135 actuator 78C.

Conversely, as the actuator 78C is allowed to move upwardly for turning the switch 10C OFF, the foot end 129 initially rises being pushed upwardly by the upward component of bow spring force, until this foot end 129 forms an abutting fulcrum at 134 (FIG. 6). While the pivotable link 104 is swinging upwardly about its fixed pivot point 106 and when the first end 52C of the switch arm begins to move upwardly, the bow spring 56C passes its toggle point, and the first end of the switch arm then quickly snaps up to its fully open position as shown in FIG. 6.

At the left (second) end of the housing 16C are auxiliary safety contact means generally indicated at 60C. These auxiliary safety contact means 60C include the pair of spaced auxiliary safety contacts 62C and 64C which slope inwardly toward each other and have external terminal portions 66C and 68C respectively. Positioned between the two contacts 62C and 64C is a movable conductive safety switch element 140 having a truncated conical cup-shape for conforming with these contacts, as seen most clearly in FIGS. 9 and 10. This safety switch element 140 is normally in open position; that is, spaced from its contacts 62C and 64C, as shown in FIGS. 6, 7 and 9, so long as the main contacts 54C, 42C do not become fused together as they are shown in FIG. 8.

Figure 8:
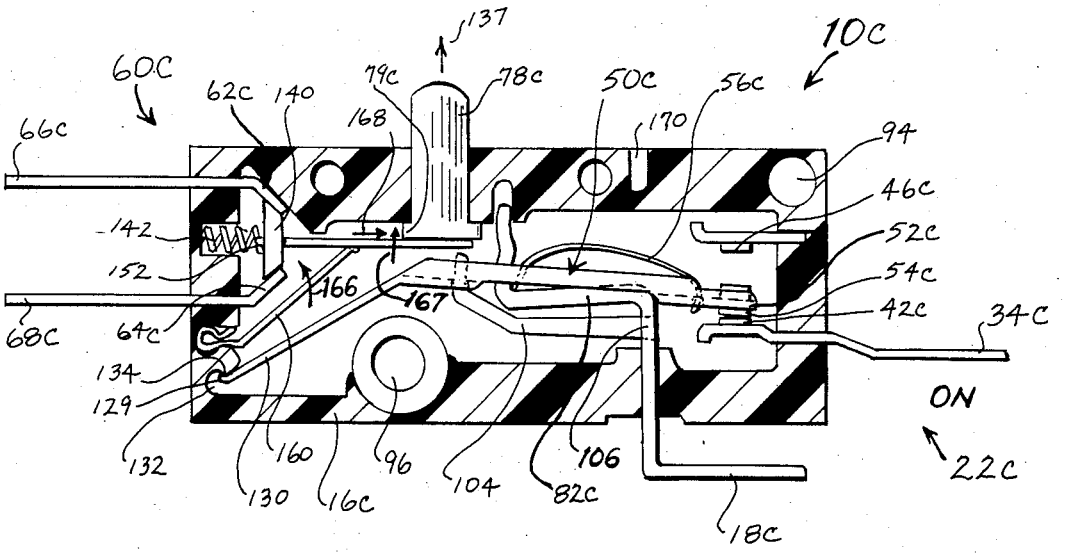
FIG. 8 is an enlarged side elevational view of the switch of FIG. 6, with the main contacts of the switch "welded" together in their ON position, after the switch operating means has been moved to OFF position. Consequently, auxiliary safety contact means within the switch have been released to move into a second relationship for producing a safety function.
Figure 9:
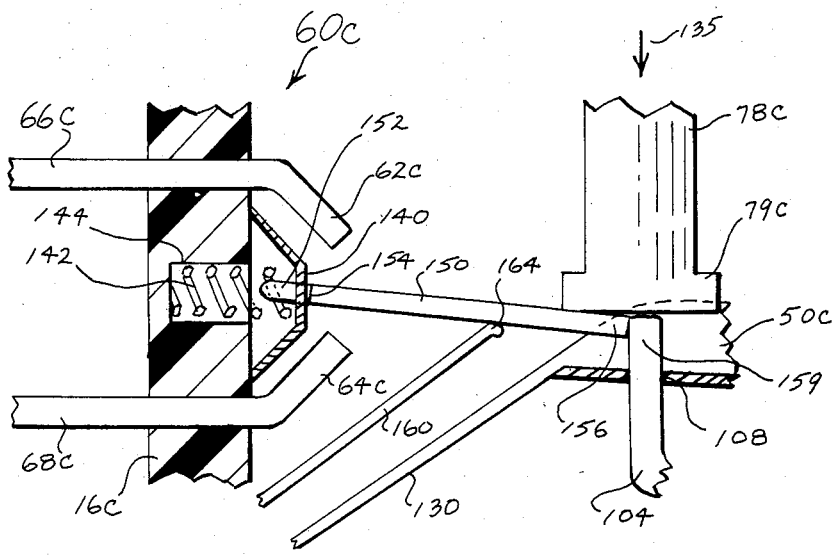
FIG. 9 is a further enlargement of a portion of FIG. 7 showing in greater detail how the auxiliary safety contact means are being held in their first relationship against the force of a cocked spring while the switch continues to operate in normal manner.
Figure 10:
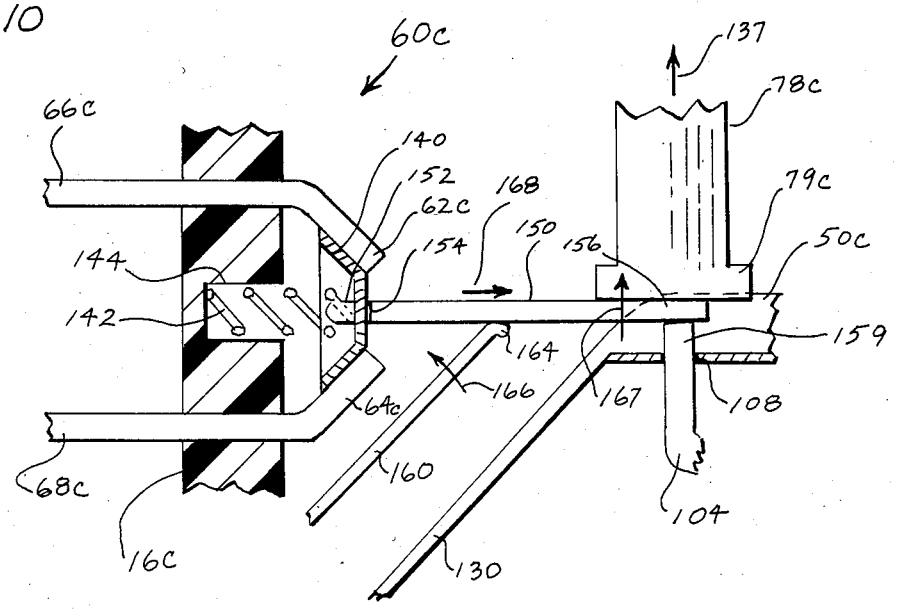
FIG. 10 is a further enlargement of a portion of FIG. 8 showing in greater detail how the auxiliary safety contact means released so that the cocked spring can immediately move them into a second relationship for producing a safety function, when the switch operating means are moved to OFF position but the main switch contacts remain "welded" together in their ON position.

A coil spring 142 seating in a recess 144 presses against the switch element 140 for urging it toward closed position wherein it bridges across between its contacts 62C, 64C, as shown in FIGS. 8 and 10. In order to control the auxiliary safety switch means 60C by normally restraining the switch element 140 against the switch-closing bias force of the spring 142, there is a rod-like control member 150, as illustrated most clearly in FIGS. 9 and 10. As will be explained later, this control member 150 is operatively associated with the switch operating mechanism, which includes the actuator 78C, the switch arm 50C and its leg 130 and the hinged link 104 plus bow spring 56C. This control member 150 has one of its ends 152 (FIGS. 9 and 10) inserted in loose-fitting relationship through a hole in the center of the switch element 140, and it has a pair of shoulders 154 (only one is seen) against which the switch element 140 is pushed by the spring 142.

The second end 156 of the control member 150 is normally being pushed toward the right by the bias spring 142, so that this end 156 thrusts against the upper end 159 of the hinged link 104. This end 159 of the link 104 extends up through an opening or slot 108 in the switch arm 50C. Thus, the control member 150 is normally prevented from moving toward the right under the bias force of the spring 142, because its second end 156 is abutting against the upper end 159 of the link 104 which acts as a mechanical stop. Preferably to electrically isolate the auxiliary safety contact means 60C from the remainder of the switch components, then the control member 150 is formed from rigid insulating material.

In addition to the switch-closing compression spring 142, there is a leaf spring 160 which serves as a trigger spring. This trigger spring 160 has its second end 158 anchored in a socket 162, while its first end 164 continually exerts an upward force on the control member 150, i.e. exerts a force in a direction generally transverse with respect to the length of said control member.

When the actuator 78C is depressed as shown by arrow 135 (FIGS. 7 and 9) turning the switch ON, the control member 150 swings (tilts) downwardly as its second end 156 (FIG. 9) is pushed down by the actuator. Its first end 152 is sufficiently loosely received in the hole in the switch element 140 for allowing this slight tilting movement of the control member 150 without also tilting the switch element. Conversely, when the actuator is moved to OFF position, the control member 150 swings back up to a more nearly horizontal position as shown in FIG. 6. Thus, in this normal ON and OFF operation, the second end 156 of the control member always remains abutting against the upper end 159 of the hinged link 104. The rightward thrust of the safety switch-closing spring 142, which causes a rightward thrust of the control member 150 against the end 159 of the hinged link 104 which, in turn, causes a rightward thrust of the hinged link 104, is ultimately resisted by the fixed pivot at 106 where the end of link 104 is hingedly received in a socket slot in the portion 82C of the fixed common terminal 82C.

In the event that the main contacts 54C, 42C remain welded, fused, or stuck together as shown in FIG. 8 when the actuator 78C is allowed to move upwardly as indicated by arrow 137 for turning the switch OFF, then these joined-together contacts 54C–42C act as a hinge or pivot point to prevent the first end 52C of the switch arm 50C from rising. The upward component of force exerted by bow spring 56C causes the second end of the switch arm to swing up until the foot end 129 of leg 130 abuts against the recess wall at 136 preventing further upward movement of the switch arm. That is, the upward motion of the switch arm 50C is now totally arrested at both of its ends, but the first end 164 of the trigger spring 160 continues to lift upwardly on the control member 150 indicated by the curved arrow 166 (FIGS. 8 and 10).

Thus, the switch operating means has assumed an abnormal position when the upward motion of the switch arm 50C is arrested at both ends while the actuator 78C is being moved toward OFF position.

As seen most clearly in FIG. 10, this trigger spring now causes the second end 156 of the control member 150 to be lifted as shown by arrow 167 above the end 159 of the link 104, thus immediately releasing the control member 150 to move to the right as indicated by arrow 168, thus allowing the compressed or cocked spring 142 to quickly move the switch element 140 into its closed position bridging across between safety contacts 62C and 64C for automatically effecting a desired safety function. The desired safety function(s) which is (are) effected by closure of the auxiliary safety contact means 60C is (are) determined by the particular arrangement of the associated control circuit, for example, such as the circuit 12C shown in FIG. 11, for deactivating the electrical equipment 14 and for giving an alarm signal.

Figure 11:
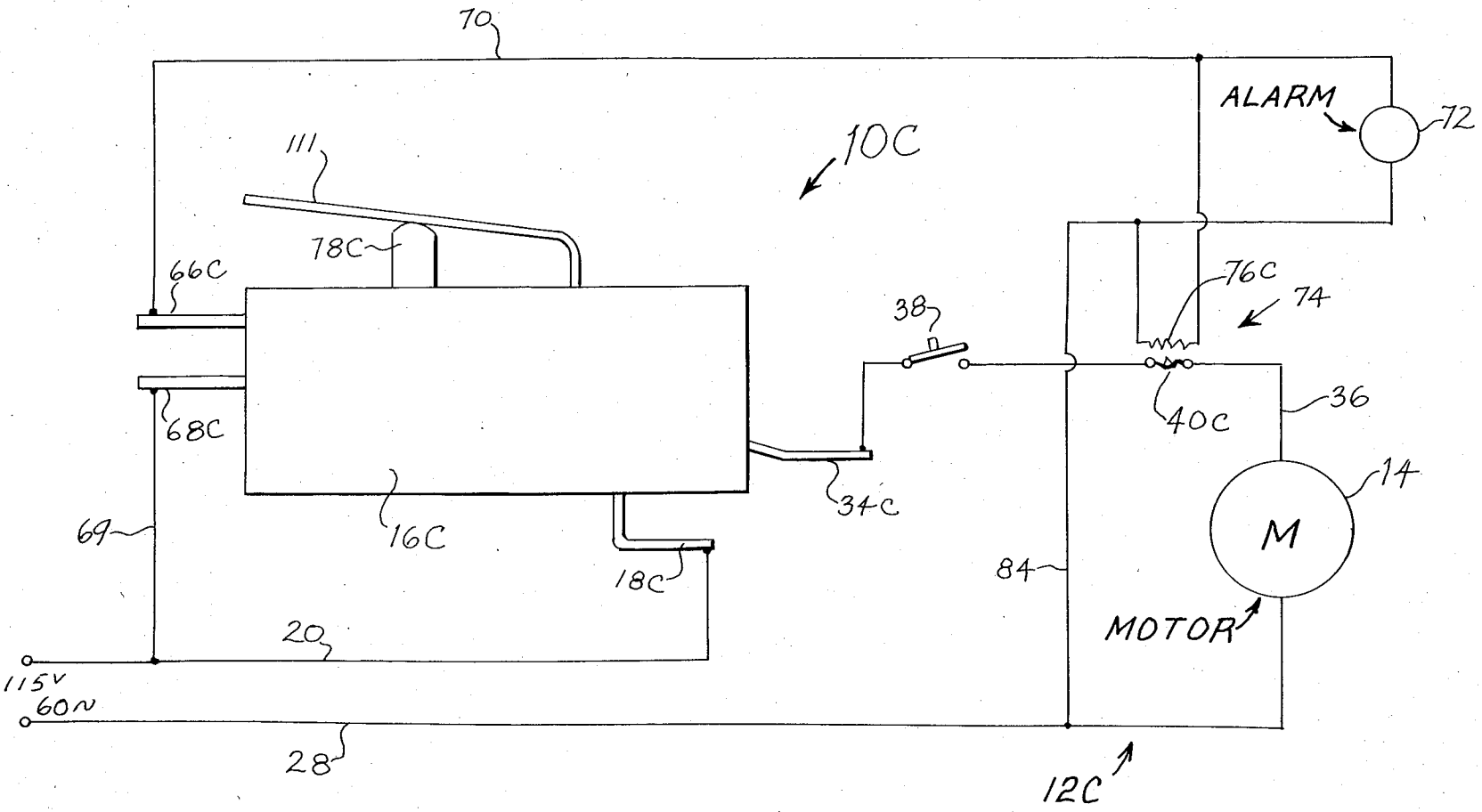
FIG. 11 shows the switch of FIGS. 6 through 10 connected in a circuit including electrical equipment which is controlled by this switch.

The control circuit 12C shown in FIG. 11 is similar to the control circuit 12 shown in FIGS. 1 and 2, except that the OFF terminal 24 and the brake 32 are omitted. Also, the deactivating means 74, is shown as including a fast-acting heater 76C near a fuse 40C.

It is to be understood that the switch 10C is adapted to include an L-shaped actuator lever for depressing the actuator 78C, similar to the lever 111 in FIG. 5. The fixed end of this actuator lever is mounted in an external socket 170 in the housing 16C.

Also, it is to be understood that physical orientation terms, such as "horizontal", "up", "upper", "upward", "upwardly", "rises", "higher", "above", "down", "downward", "downwardly", "lower", "below", "right", "rightward", "left", "leftward", "leftwardly", and similar terms, are set forth for convenience of the reader in readily understanding the description with reference to the drawings as shown and these terms are not intended to be limiting. The switches 10, 10A, 10B, 10C can be installed and mounted and will operate properly in any desired orientation, because their various components are operated by mechanical motions and by spring forces without any significant effect by the earth's gravity.

It is to be understood by those skilled in the art that various modifications may be made in the described embodiments of the present invention, without departing from the spirit and scope of the present invention, as described in the specification and defined in the appended claims, which provides a switch with auxiliary safety contact means which are changed in position when the switch is turned OFF, if the ON contacts remain fused, welded or stuck together, for automatically effecting a safety function, for example to prevent operation of the electrical equipment, to protect the operator or maintenance personnel from injury from unexpected actuation of the electrical equipment in question, and/or advising them that the switch has malfunctioned.

I claim:

1. In a switch including a housing having a common terminal and an ON terminal each extending to the exterior of the housing, said ON terminal having an ON contact thereon located within the housing, a movable switch arm having first and second ends in the housing with movable contact means carried by the first end of said movable switch arm, the movable switch arm being movable between open and closed positions, first spring means in the housing for urging the movable switch arm to its normal open position, movable actuator means accessible from the exterior of the housing and operatively associated with the movable switch arm for moving the movable switch arm from its normal open position for causing the movable contact means carried by the first end of the movable switch arm to touch said ON contact when the movable switch arm is in its closed position, the actuator means when released allowing the spring means to return the movable switch arm from its closed to its normal open position, and electrically conductive means in the housing for completing an electrically conductive path between the common terminal and the ON terminal when the movable contact means touches the ON contact, means for automatically producing a safety function in the event the movable contact means becomes welded to the ON contact thus causing the movable switch arm to assume an abnormal position when the actuator means have been released, comprising:

safety switch means located within the housing and positioned proximate to said movable switch arm, said safety switch means including at least one terminal extending to the exterior of the housing for connection to a circuit, and said safety switch means being changed for enabling a safety function to be provided in response to said movable switch arm assuming an abnormal position occurring when said actuator means have been released and said spring means attempts to return said movable switch arm to its open position while said movable contact means is welded to the ON contact.

2. The switch recited in claim 1, wherein:

said safety switch means include at least one safety terminal extending into the interior of the housing and having a safety contact located within the housing, a movable contact element is associated with said safety contact and is movable between first and second positions with respect to said safety contact, said movable contact element normally is in said first position with respect to said safety contact, and said movable contact element is moved into said second position with respect to said safety contact in response to said switch arm assuming said abnormal position.

3. The switch as claimed in claim 1 wherein:

a movable contact element associated with a safety contact and is movable between first and second positions with respect to said safety contact, second spring means located within the housing urge said contact element to move from said first to said second position, and control means within the housing are responsive to the position of said switch arm for normally constraining said second spring means for preventing said contact element from moving from said first to said second position, and said control means release said second spring means to move said contact element from said first to said second position with respect to said safety contact in response to said switch arm assuming said abnormal position.

4. The switch recited in claim 1, wherein:

said safety switch means include at least one safety terminal extending into the interior of the housing and having a safety contact located within the housing, a movable contact element is associated with said safety contact and is movable between first and second positions with respect to said safety contact, second spring means located within the housing urge said contact element to move from said first to said second position, movable control means within the housing normally engaged with the switch arm for constraining said second spring means against moving said contact element from said first to said second position, and a trigger spring operatively associated with said movable control means for causing said control means to become disengaged from the switch arm in response to said switch arm assuming said abnormal position for releasing said second spring means to move said contact element from said first to said second position with respect to said safety contact for enabling a safety function to be provided.

5. The switch recited in claim 3, wherein:

said movable contact element is spaced from said safety contact when said movable contact element is in said first position, and said second spring means is released in response to said switch arm assuming said abnormal position to move said contact element from said first position spaced from said safety contact into said second position touching said safety contact for enabling a safety function to be provided.

6. The switch recited in claim 4, wherein:

said safety switch means include a pair of spaced safety terminals extending into the interior of the housing and each having a contact located within the housing, the pair of safety contacts being spaced apart, said movable contact element in said first position is spaced from said pair of safety contacts, and said second spring means urge said contact element to move from said first position to said second position in which said contact element bridges across between said pair of safety contacts for completing a conductive path through said pair of safety terminals for enabling a safety function to be provided.

7. The switch recited in claim 6. wherein:

said pair of spaced safety contacts extend toward each other, said movable contact element is located between said safety terminals, and said second spring means is a compression spring seated against the housing and engaging said contact element for urging said contact element toward said pair of safety contacts for bridging across between said pair of safety contacts for completing the conductive path between them.

8. The switch recited in claim 1, wherein:

said safety switch means include first and second safety terminals each extending into the interior of the housing, each of said first and second terminals having a contact portion located within the housing, second spring means positioned in the housing in electrical contact with said contact portion of said first safety terminal and in engagement with said second end of said movable switch arm, and said second spring means assuming an abnormal position when said movable switch arm assumes said abnormal position for engaging said contact portion of said second safety terminal for providing a connection between said first and second safety terminals.

9. The switch recited in claim 8, wherein:

said second spring means is configured with a short spring arm positioned in engagement with said contact portion of said first safety terminal and a long spring arm engaging said second end of said movable switch arm, and locating pin means in the housing receives said second spring means for positioning it relative to said first and second safety terminals.

10. The switch recited in claim 9, wherein:

said second end of said movable switch arm includes a notched portion for engaging said long spring arm.

11. The switch recited in claim 1, wherein:

said safety switch means include at least one safety terminal extending to the exterior of the housing, said safety terminal having a contact portion located within the housing, second spring means positioned proximate to said contact portion of said safety terminal and normally held in a predetermined relationship with respect to said contact portion by said movable switch arm during normal movement of said switch arm into its closed and open positions, and said second spring means being allowed to move into another predetermined relationship with respect to said contact portion when said movable switch arm assumes said abnormal position.

12. The switch recited in claim 1, wherein:

said safety means include a pair of terminals each extending into the interior of the housing, each of said terminals of said pair of terminals having a contact portion located within the housing, said contact portions of said pair of terminals being closed by said movable switch arm when said movable switch arm assumes said abnormal position when said movable actuator means has been released and said spring means attempts to return said movable switch arm to its open position.

13. The switch recited in claim 1, wherein:

said safety switch means include a single terminal extending to the exterior of the housing, said single terminal having a contact portion located within the housing, said contact portion of said single terminal being touched by an extension of said movable switch arm to provide an electrically conductive path between said common terminal and said single terminal when said movable switch arm assumes said abnormal position when said movable actuator means has been released and said spring means attempts to return said movable switch arm to its open position.

14. A switch for automatically effecting a safety function when its contacts are fused together in the ON position, comprising:

a housing including a pairof contacts arranged therein and spaced relative to one another, one of said pair of contacts being designated an ON contact and the other of said pair of contacts being designated an OFF contact, a movable switch arm positioned in said housing, said movable switch arm having a first end with movable contact means thereon and having a second end, spring means mechanically coupled to said movable switch arm for normally biasing said movable contact means into engagement with said OFF contact, actuator means for overcoming the biasing force of said spring means for moving said movable contact means into engagement with said ON contact, and safety contact means positioned proximate to said second end of said movable switch arm for changing a conductive path for automatically effecting a safety function in response to abnormal movement of said movable switch arm under the influence of the biasing force of said spring means when said actuator means are deactivated and said movable contact means are fused to said ON contact.

15. The switch for automatically effecting a safety function as recited in claim 14, wherein:

said safety contact means includes a pair of safety contacts located within said housing, and said pair of safety contacts become closed in response to the abnormal movement of said movable switch arm when said movable contact means are fused to said ON contact and said movable actuator means are deactivated.

16. The switch for automatically effecting a safety function as recited in claim 14, wherein:

said safety contact means includes a single contact located within said housing, said single contact becoming closed with another contact in response to said abnormal movement of said movable switch arm when said movable contact means are fused to said ON contact and said actuator means are deactivated.

17. A method capable of providing a safety function when contacts of a switch are fused together in the ON position wherein the switch includes a pair of contacts spaced relative to one another, one of the pair of contacts being designated an ON contact and the other being designated an OFF contact, said method comprising the steps of:

providing safety contact means, positioning a movable switch arm having a first end and a second end proximate to the pair of contacts and proximate to the safety contact means so that the first end engages the ON contact when the switch is in the ON position and the OFF contact when the switch is in the OFF position, biasing the movable switch arm toward a first position for engagement with the OFF contact, applying a deflecting force to the movable switch arm to deflect it into a second position for engagement with the ON contact for completion of a circuit to an electrical load, and changing an auxiliary circuit through the safety contact means in response to abnormal movement of the movable switch arm when the deflecting force is removed and the first end of the movable switch arm remains fused to the ON contact.

18. The method recited in claim 17, wherein:

the step of changing the auxiliary circuit includes releasing a spring to change the position of the safety contact means in response to said abnormal movement of the movable switch arm.

19. The method of operating an electrical switch for effecting a safety function when a movable contact welds to another contact in the closed position wherein a movable member carries the movable contact, said member being movable between an open and a closed position in response to operation of an actuator and in which the movable contact normally releasably engages another contact in the closed position comprising the steps of:

arranging for the movable member to assume an abnormal position when the movable contact is welded to the other contact in the closed position and the actuator is operated to move the member to the open position, and sensing the abnormal position of said movable member for effecting a safety function due to such malfunction of the switch.

20. The method as claimed in claim 19, including the steps of:

extending the effective length of said movable member, and sensing the abnormal position of the effective extension of said movable member..

21. The method as claimed in claim 19, including the steps of:

providing safety contact means movable between a first and a second position, urging said contact means toward said second position by a stressed spring, normally restraining said stressed spring for retaining said safety contact means in said first position, and releasing the stressed spring to move the safety contact means into the second position in response to the movable member assuming the abnormal position.

22. The method as claimed in claim 21, including the steps of:

providing a trigger force continuously thrusting in a direction for releasing said stressed spring, preventing said trigger force from acting to release said stressed spring so long as said movable member occupies normal positions in moving between said open and closed positions, and causing said trigger force to act to release said stressed spring in response to the movable member assuming the abnormal position.

23. An electrical switch for enabling a safety function to be effected when a movable contact welds to another contact in the closed position wherein a movable member in a switch housing carries the movable contact, said member being movable between an open and a closed position in response to operation of an actuator and in which the movable contact normally releasably engages the other contact in the closed position comprising:

said movable member capable of assuming an abnormal position when the movable contact is welded to the other contact in the closed position and the actuator is operated to move the member to the open position, responsive means in the switch housing for sensing the abnormal position of said movable member; and at least one element extending from said switch housing connected to said responsive means for enabling a safety function to be effected to protect from malfunction of the switch.

24. An electrical switch as claimed in claim 23, in which:

said responsive means includes an effective extension of a portion of said movable member, said effective extension moving with said member.

25. An electrical switch as claimed in claim 23, in which:

said responsive means includes auxiliary contact means movable between a first and a second relationship, a stressed spring urging said auxiliary contact means from said first to said second relationship, and control means normally restraining said stressed spring to keep said auxiliary contact means in said first relationship, said control means releasing said stressed spring for moving said auxiliary contact means to said second relationship in response to the abnormal position of said movable member.

26. An electrical switch as claimed in claim 23, in which:

said element extending from said switch housing is a safety terminal, said responsive means include a first safety contact within the housing electrically connected to said safety terminal, and a movable switch element which is movable between a first and a second position with respect to said first safety contact, a stressed spring is associated with said switch element for urging said switch element to move from said first to said second position, movable control means within the housing is normally engaged with said movable member for restraining said stressed spring against moving said switch element from said first to said second position, and a trigger spring is associated with said movable control means for disengaging said control means from said movable member in response to said movable member assuming said abnormal position for releasing said stressed spring to move said movable switch element from said first to said second position with respect to said first contact for enabling a safety function to be effected.

27. An electrical switch as claimed in claim 26, in which:

there are first and second spaced safety terminals extending from said switch housing, said responsive means include a first safety contact within the housing electrically connected to said first safety terminal and a second safety contact within the housing electrically connected to said second safety terminal, said first and second safety contacts being spaced apart and extending toward each other, said movable switch element being positioned within the housing generally between said first and second safety contacts and having first and second positions, said switch element in said first position being spaced from said first and second safety contacts, and releasing said stressed spring moves said switch element into said second position bridging across between said first and second safety contacts for completing a conductive path between said safety terminals for enabling a safety function to be effected.

28. In a switch having first and second main contacts, switch operating means movable in a first direction for causing said main contacts to touch each other for turning the switch ON, said switch operating means being movable in a second direction for causing said main contacts to separate for turning the switch OFF, switch safety apparatus in said switch comprising:

first and second auxiliary contact means, a movable member operatively associated with said first and second auxiliary contact means and with said switch operating means, said first auxiliary contact means normally being held by said movable member in a first relationship with respect to said second auxiliary contact means, spring bias urging said movable member for moving said first auxiliary contact means into a second relationship with respect to said second auxiliary contact means for effecting a safety function, said movable member normally being restrained against said spring bias by said switch operating means, and said movable member being released to become moved by said spring bias in the event that said switch operating means are moved in said second direction for turning the switch OFF but said main contacts do not become separated and thus the switch is actually not OFF, said movable member being released to be moved by said spring bias for moving said first auxiliary contact means into said second relationship with respect to said second auxiliary contact means for effecting said safety function.

29. In a switch, the switch safety apparatus in the switch as set forth in claim 28, wherein:

a trigger spring is associated with said movable member for releasing said movable member to become moved by said spring bias in the event that said switch operating means are moved in said second direction but said main contacts do not become separated.

30. In a switch, the switch safety apparatus in the switch as set forth in claim 29, wherein:

said movable member is a rod-like member, said spring bias urges said rod-like member for motion generally in a direction longitudinally thereof, and said trigger spring urges said rod-like member for motion generally in a direction laterally with respect to the length thereof.

31. In a switch having first and second main contacts, switch operating means movable in a first direction for causing said main contacts to touch each other for turning the switch ON, said switch operating means being movable in a second direction for causing said main contacts to separate for turning the switch OFF, switch safety apparatus in said switch comprising:

first and second auxiliary contact means, said first auxiliary contact means normally being in a first position with respect to said second auxiliary contact means, said first auxiliary contact means being movable into a second position with respect to said second auxiliary contact means for effecting a safety function, a movable member normally operatively associated with said switch operating means in a first relationship, and said member becoming associated with said switch operating means in a second relationship moving said first auxiliary contact means into said second position with respect to said second auxiliary contact means for effecting said safety function when said switch operating means are moved in said second direction but said main contacts do not become separated and thus the switch is actually not OFF.

32. In a switch, the switch safety apparatus in the switch as set forth in claim 31, wherein:

a stressed spring is associated with said movable member for moving said movable member to move said first auxiliary contact means into said second position with respect to said second auxiliary contact means, and a trigger spring is associated with said movable member for moving said movable member into said, second relationship with respect to said switch operating means when said switch operating means are moved in said second direction but said main contacts do not become separated.

33. In a switch, the switch safety apparatus in the switch as set forth in claim 32, wherein:

said movable member is elongated, said stressed spring moves said elongated member generally in a longitudinal direction, and said trigger spring moves one end of said elongated member generally in a transverse direction.

34. A safety switch having a housing containing a first main contact, a second main contact carried by a movable switch arm and switch operating means being actuatable for moving said movable arm to an ON position in which said second main contact touches said first main contact and said switch operating means being actuatable for moving said switch arm to an OFF position in which said second main contact is separated from said first main contact, said safety switch comprising:

a safety contact within said switch housing, a movable conductive safety switch element within said housing movable from a first position to a second position with respect to said safety contact, said switch element being against said safety contact in one of said first and second positions for completing a conductive path through said safety contact and said safety switch element and said switch element being spaced from said safety contact in the other of said first and second positions for interrupting said conductive path, bias spring means in said housing operatively associated with said safety switch element for urging said safety switch element from said first position to said second position, control means within said housing interposed between said switch operating means and said safety switch element normally holding said safety switch element in said first position in spite of the urging of said bias spring means, said control means becoming immediately released from holding said safety switch element in said first position if said switch operating means is actuated for moving said switch arm to its OFF position but said second main contact does not separate from the first main contact, and said bias spring means immediately moving said safety switch element from said first position to said second position upon said control means becoming released.

35. A safety switch as claimed in claim 34, in which:

said switch operating means include a movable actuator extending out of said housing, said actuator has an inner end, said inner end of said actuator is normally adjacent to said movable switch arm, said control means includes a control member extending partially between said inner end of said actuator and said movable switch arm, and said control means becomes immediately released by said control member extending further between said inner end of said actuator and said movable switch arm, and said control means become immediately released by said control member extending further between said inner end of said actuator and said movable switch arm if said actuator is moved for moving said switch arm to its OFF position but said second main contact does not separate from said first main contact.

* * * * *